United States Patent [19]

Yamamoto

[11] Patent Number: 4,612,740

[45] Date of Patent: Sep. 23, 1986

[54] FALL PREVENTION MEANS FOR FURNITURE

[76] Inventor: Shigekazu Yamamoto, 20-11, Nishiogu 3-chome, Arakawa-ku, Tokyo, Japan

[21] Appl. No.: 529,989

[22] Filed: Sep. 7, 1983

[30] Foreign Application Priority Data

Sep. 9, 1982 [JP] Japan ..... 57-136790[U]
Dec. 28, 1982 [JP] Japan ..... 57-201406[U]

[51] Int. Cl.[4] ..... A47B 5/00

[52] U.S. Cl. ..... 52/36; 248/225.1; 52/713

[58] Field of Search ..... 52/36, 27, 29, 173 R, 52/713; 248/225.1, 225.2; 114/188, 189

[56] References Cited

U.S. PATENT DOCUMENTS 2,744,714 5/1956 Parke ..... 52/36 X
3,212,646 10/1965 Propst ..... 52/36 X
3,690,076 9/1972 Harris, Jr. ..... 52/36
4,360,991 11/1982 West ..... 52/36 X

FOREIGN PATENT DOCUMENTS 2130499 12/1972 Fed. Rep. of Germany ..... 52/36
2404411 6/1979 France ..... 248/225.2

*Primary Examiner*—Carl D. Friedman
*Assistant Examiner*—Naoko N. Slack
*Attorney, Agent, or Firm*—Armstrong, Nikaido, Marmelstein & Kubovcik

[57] ABSTRACT

A fall prevention means to keep furniture from falling by earthquakes, etc. Said means comprises a location member fixed to the surface opposite to the furniture and an engagement member secured to the furniture. Providing an opening in the furniture enables said means to be fixed with the furniture placed in a position of a room where it is to be settled finally.

5 Claims, 11 Drawing Figures

FALL PREVENTION MEANS FOR FURNITURE

The invention relates to fall prevention means for keeping furniture from falling by earthquakes and the like. The invention also relates to furniture which makes it easy to fix said fall prevention means with the furniture placed, throughout the fixing operation, in a position of a room where it is to be settled finally.

Embodiments of the invention will now be described in detail with reference to the attached drawings in which.

Figure 1:
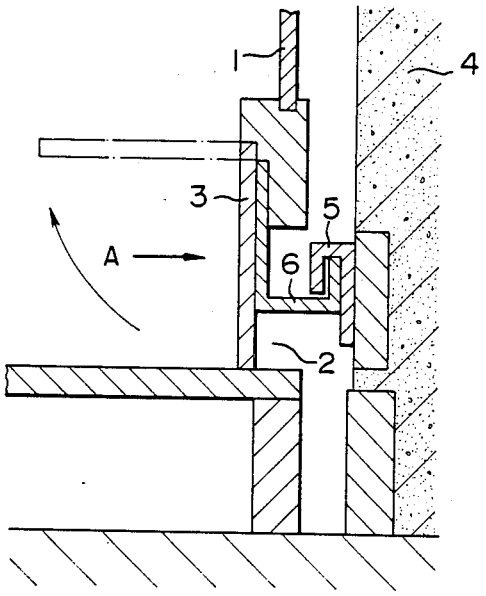
FIG. 1 is a cross section of a first embodiment of the invention.
Figure 2:
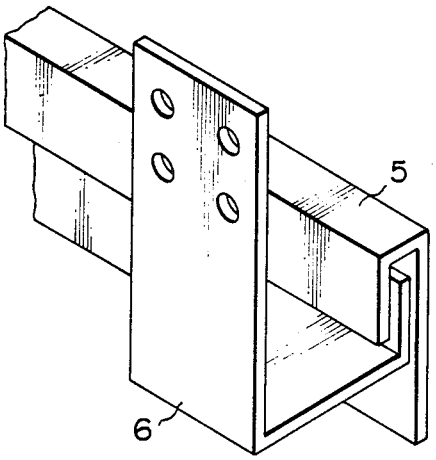
FIG. 2 is a perspective view of a location member and an engagement member of the first embodiment.
Figure 4:
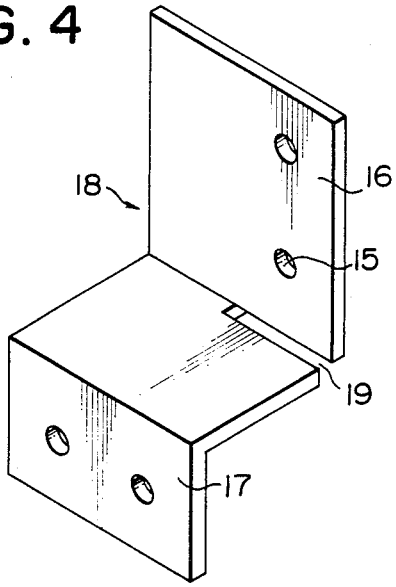
FIGS. 4 and 5 are perspective views of an engagement member and location member, respectively, used in the second embodiment.
Figure 5:
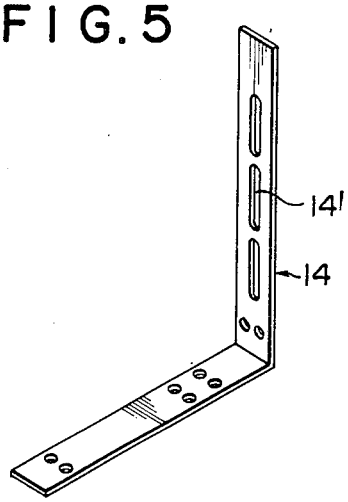

In the first embodiment of the invention shown in FIGS. 1 and 2, the furniture A is provided at the lower end of its rear board 1 with a horizontally extending opening 2 through which a human hand may be passed. The opening 2 is provided with a closure 3. A 7-shaped location member 5 is secured in advance in a position on a wall 4 where said opening 2 of the furniture A, when it is installed, will be located.

With the furniture A located in position opposite the wall 4, an inverted-7-shaped engagement member 6 is secured to near the upper edge of said opening 2 so as to interlock with the engagement member 6 through operation carried out from inside the furniture A.

Figure 3:
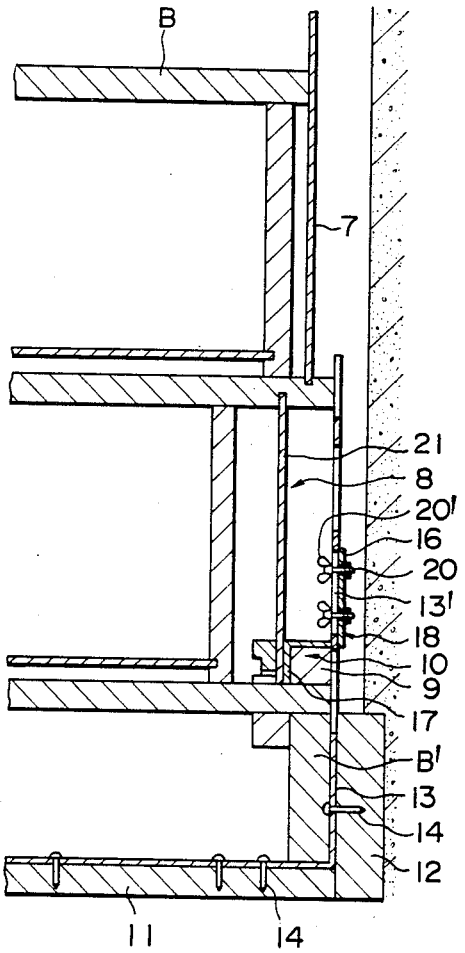
FIG. 3 is a cross section of a second embodiment of the invention.

According to a second embodiment of the invention shown in FIG. 3, the engagement member can be moved along the vertical portion of the location member for engagement or disengagement. Referring specifically to FIG. 3, a first opening 8 for fixing operation is provided under a rear board 7 of furniture B. A square bar 9 is fixed near the lower side of the opening 8 to provide a stop 10. An L-shaped location member 13 consists of horizontal and vertical portions with numerous slots 13'. The location member 13 is fixed to a floor 11 and a side board 12 by means of screws 14. The furniture B having a base B' is placed on the floor 11 so that the opening 8 faces the vertical portion of the location member 13. An engagement member 18 is made of bent metal plate and consists of an L-shaped and an inverted-L-shaped portion. Its upper vertical portion has fixing holes 15 to form an attachment portion 16 whereas its lower vertical portion forms a hook portion 17. The L-shaped portion is formed at its bent portion with a deep cut 19 from one edge. The engagement member 18 is fixed so that the vertical portion of the location member 13 engages in said cut 19 whereas the hook portion 17 locks with the stop 17 by means of screws 20 passed through the slots 13' of the location member 13 and fixing holes 15 of the engagement member 18 and tightened with wing nuts 20'.

A lid board 21 is of a type which can be removed by lifting altogether first, then pulling out its lower side from the groove, and then pulling downwards while drawing inwardly.

Figure 6:
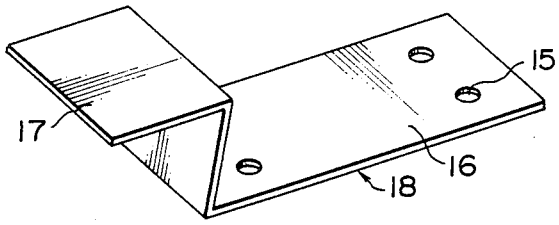
FIG. 6 is a variation of the engagement member for the second embodiment.

FIG. 6 shows a variation of the engagement member 18 for use in the second embodiment. The stop 10 may be provided by forming slots near the rear end side of the bottom board of the furniture B or may be provided in the form of metal pieces specially prepared or alternatively the periphery of the opening 8 may be used to provide the stop. Further the opening 8 may be located at the upper or middle position of the rear board of the furniture and in such case, the location member is secured to the wall surface.

Figure 7:
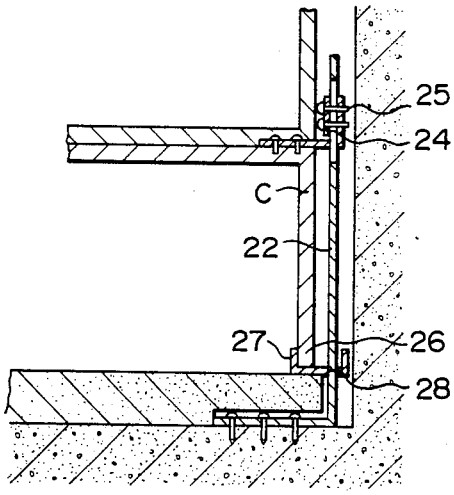
FIG. 7 is a cross section of a third embodiment of the invention.
Figure 8:
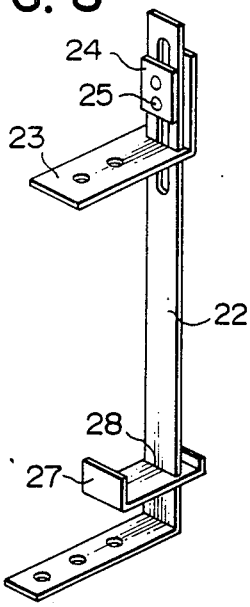
FIG. 8 is a perspective view thereof.

FIGS. 7 and 8 show a third embodiment comprising an L-shaped engagement member 23 and a U-shaped metal piece 27. The L-shaped engagement member 23 is secured to the upper part of the location member 22 by means of screws 25 and a washer 24. The U-shaped metal piece 27 has a slot 28 whereby the piece 27 can be placed in a slidable engagement with the vertical portion of the engagement member 22. The metal piece is provided to prevent furniture C moving backwards or forwards.

Figure 9:
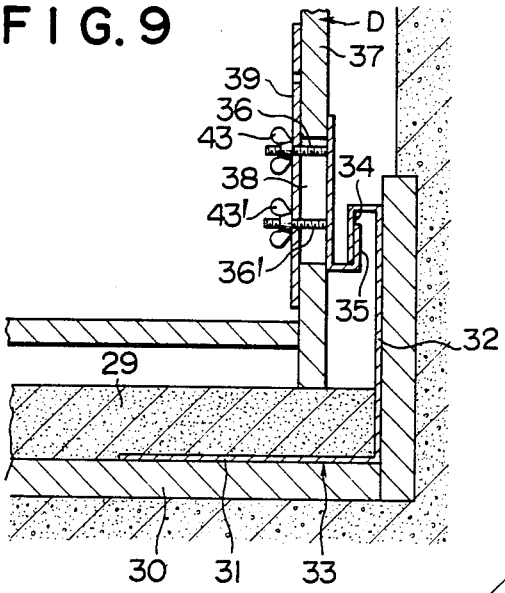
FIG. 9 is a cross section of a fourth embodiment of the invention.
Figure 10:
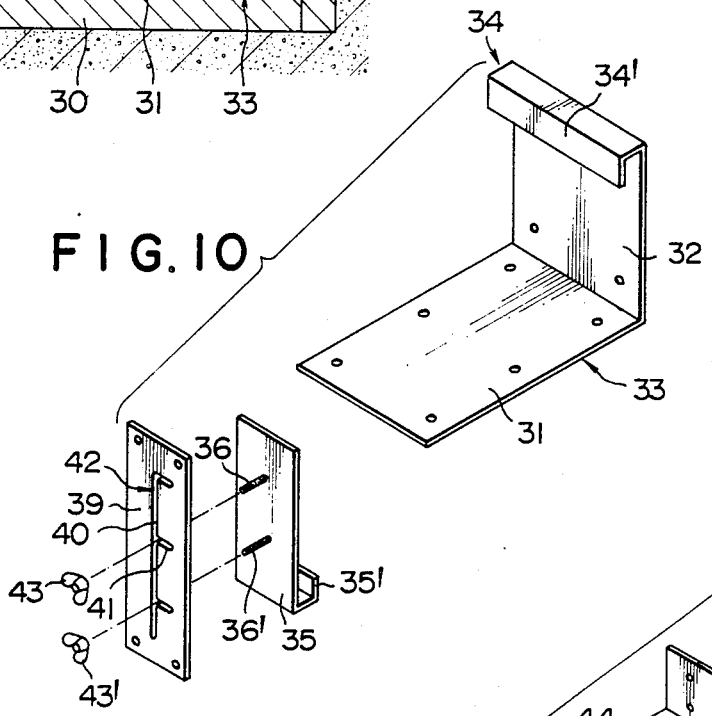
FIG. 10 is an exploded view of the fourth embodiment of the invention.

According to a fourth embodiment shown in FIGS. 9 and 10, the engagement member is secured to the outer side of the furniture. The position of said engagement member can be adjusted through operation performed from inside the furniture so as to interlock with a hook portion of the location member. An L-shaped location member 33 shown is made of metal plate and consists of a horizontal portion 31 and a vertical portion 32. The horizontal portion 31 may be held in position by inserting between a floor covering material 29 such as tatami or carpet and a floor board 30. The vertical portion 32 has a 7-shaped hook portion 34 at its upper end. An inverted-7-shaped engagement member 35 is made of metal plate and is provided on its longer vertical portion with screws 36, 36' projecting perpendicularly to it. Said screws 36, 36' are allowed to pierce a rear board 37 of furniture D from outside through a through hole 38 formed in the rear board 37. A lid board 39 made of metal plate and having a guide slots 42 consisting of vertical slot 40 and horizontal slots 41 is fixed to the inner wall of the rear board 37 by screws (not shown) to shut the through hole 38 so as to pass the screws 36, 36' through said guide slots 42. The ends of said screws 36, 36' are tightened by wing nuts 43, 43'. Upon loosening the nuts, the height of the engagement member 35 can be altered by grabbing the wing nuts to move the screws 36, 36' along the vertical slot 40. The engagement member 35 can be fixedly located by engaging the screws 36, 36' in the horizontal slots 41 and tightening the wing nuts 43, 43'. Upon placing the furniture D in position, the shorter vertical portion 35' of the engagement member 35 may be engaged with or disengaged from the shorter vertical portion 34' of the hook portion 34 by adjusting the position of the engagement member 35 in a vertical direction.

Figure 11:
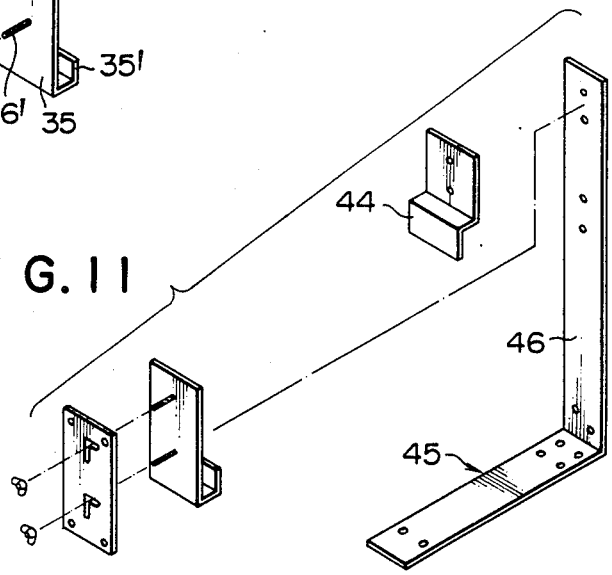
FIG. 11 is an exploded view of a fifth embodiment of the invention.

According to a fifth embodiment shown in FIG. 11, a hook portion 44 is separately provided to a location member 45 so as to be movable in a vertical direction in relation to a vertical portion 46 of the location member 45.

Alternatively, the hook portion may be provided so as to be movable in a horizontal direction for locking or unlocking with the engagement member.

Providing an opening in an appropriate position of furniture enables the fall prevention means of the invention to be fixed with the furniture placed in a position of a room where the furniture is to be finally settled.

I claim:

1. A fall prevention means for furniture comprising:

(a) a location member fixed to the surface of a room against which surface the furniture is to be located, said location member having a vertical portion spaced from said wall, (b) an engagement member fixed to the furniture and adapted to be slidable along the vertical portion of said location member, and (c) adjustable connecting means to detachably connect said location member and said engagement member when said furniture is solidly supported with respect to said room surface, said adjustable connecting means including a slot in said engagement member so that said location member may slide in said slot and be securely affixed at a predetermined location.

2. A fall prevention means for furniture as claimed in claim 1 wherein said adjustable connecting means comprises a slot in said engagement member so that the locating and engagement members may be securely affixed together at a predetermined location.

3. A fall prevention means for furniture as claimed in claim 1 wherein said location member has a depending flange, said engagement member has an upstanding flange for interfitting with said depending flange, and a slotted plate affixed to said furniture to adjust the position of said furniture with respect to said engagement member.

4. A fall prevention means for furniture as claimed in claim 1 wherein said location member is slotted in said vertical portion, said engagement member is attached to said location member along said slot, and said location member carries a U-shaped clip slidable along said vertical portion and adapted to engage and secure a vertically extending projection on said furniture.

5. A fall prevention system as claimed in claims 1 or 2 or 3, wherein said engagement and location members may be securely attached by bolts and wing nuts at a predetermined position.

* * * * *